United States Patent [19]

Perez de la Orden

[11] Patent Number: 4,533,021

[45] Date of Patent: Aug. 6, 1985

[54] LIFT EXIT EMERGENCY SAFETY SYSTEM

[76] Inventor: Marcelino Perez de la Orden, Calle Sancho, Ramirez No. 15, Pamplona, Spain

[21] Appl. No.: 551,930

[22] Filed: Nov. 15, 1983

[30] Foreign Application Priority Data

Nov. 15, 1982 [ES] Spain ..... 517.396

[51] Int. Cl.[3] ..... B66B 5/02

[52] U.S. Cl. ..... 187/29 R; 187/20; 318/367

[58] Field of Search ..... 187/29, 29 R, 8, 11, 187/17, 20, 23, 25, 26, 27, 28, 44, 45, 73, 78, 81, 89

[56] References Cited

U.S. PATENT DOCUMENTS

| | | | |
|---|---|---|---|
| 3,120,880 | 2/1964 | Jaseph | 187/20 X |
| 3,144,917 | 8/1964 | Tressel | 187/29 R |
| 3,162,793 | 12/1964 | Mason | 318/367 X |
| 3,469,657 | 9/1969 | Sgroi | 187/29 R |
| 3,902,573 | 9/1975 | Grove et al. | 187/29 R |
| 4,030,007 | 6/1977 | Price et al. | 318/744 |
| 4,108,280 | 8/1978 | Eastcott et al. | 187/20 |
| 4,220,222 | 9/1980 | Kamaike et al. | 187/29 R |
| 4,364,453 | 12/1982 | Serina | 187/29 R |
| 4,422,531 | 12/1983 | Ohtomi et al. | 187/20 |
| 4,433,755 | 2/1984 | Ohtomi | 187/20 |

FOREIGN PATENT DOCUMENTS

| | | | |
|---|---|---|---|
| 1244318 | 8/1971 | United Kingdom | 187/20 |

*Primary Examiner*—William M. Shoop
*Assistant Examiner*—Paul Shik Luen Ip
*Attorney, Agent, or Firm*—Wenderoth, Lind & Ponack

[57] ABSTRACT

A safety device for the emergency evacuation of a cabin at a safe floor in an elevator shaft includes a main motor, a three-phase current cable, a conveyor, an electric brake, an inertia flywheel, wheels positioned around the outer periphery of the inertia flywheel for driving/stopping such flywheel, a gripper frame positioned around the outer periphery of the inertia flywheel for pushing the driving/stopping wheels against such outer periphery, an electromagnet for actuating the gripper frame, and an auxiliary motor for supplying electrical energy to the driving/stopping wheels.

5 Claims, 4 Drawing Figures

LIFT EXIT EMERGENCY SAFETY SYSTEM

BACKGROUND OF THE INVENTION

1. Field of the Invention

The present invention relates to a safety device for the evacuation of lifts in emergencies.

2. Description of the Prior Art

The present invention exhibits some significant advantages over all those prior art devices known hitherto and whose most outstanding characteristic is that, in the event of failure of one of the phases of the main lift motor, the main supply thereof is automatically interrupted. In fact, as known, if the lift is carrying a greater weight than the counter-weight, the direction of rotation of the motor can be reversed, causing the rising of the lift to be converted into a rapid descent. This descent is stopped and limited only by the emergency air chute with the resultant danger, inconvenience and shock for the users.

SUMMARY OF THE INVENTION

With the present invention, when an emergency arises due to failure of a single phase or if two or three phases fail, the supply of the main motor is disconnected and certain contacts close, enabling an emergency motor to be started up by actuating a switch if the lift does not perfectly face one of the floors so that it can be evacuated without danger.

The present invention has the additional advantage that this device is very easy to install and does not necessitate major alterations to the lift, this advantage being considerably increased by the low cost of the elements constituting the device.

The present invention is controlled by a low consumption electronic circuit of simple design, small volume and reduced cost which monitors the existence or non-existence of voltage in each of the three phases and emits orders to relays which automatically disconnect the contact between the three phase network and the main motor, at the same time connecting the circuit which sets the auxiliary emergency elements into operation, enabling the lift to travel to the closest story without having to manipulate the inertia flywheel thereof directly.

This feature is very important since some state and national laws, e.g. Article 92.1 of the Regulation on Lift Apparatus published by the Spanish Ministry of Industry, specifically prohibits the use of hand brakes or flywheels with holes for manual actuation of lifts.

In fact, this device requires neither manipulation nor work on the flywheel since it is surrounded by a jaw which is normally loose and does not therefore interfere with the movement of the lift and, in an emergency, grips the flywheel, transmitting the movement of a wheel thereto due to the pressure exerted on this wheel against the flywheel by some jaws which are always held externally to the said flywheel.

Consequently, when the emergency occurs, with the failure in one or all of the phases of the main motor, the electronic circuit conveys a signal, as indicated, which disconnects the supply of the main motor and closes a contactor in series with an interrupter which, when a switch, hereinafter called the emergency switch, is pushed, causes current to pass through the electric brake and the electromagnet, bringing together the jaws which impel a wheel against the inertia flywheel of the lift. This wheel is set into motion by an auxiliary motor which, in parallel with the electric brake and the electromagnet for clamping, has been set into operation by the action of an energy source which may be a storage battery kept constantly charged.

The circuit is completed by respective pairs of magnetic position sensors located in the cabin and in which, when the metal screens, of which there is one on each floor, are introduced on reaching its exact position, the supply of the electronic circuit is opened as are the relays of the auxiliary equipment since all these pairs of sensors are interconnected and inserted into the circuit in series.

In the event of fire, it is necessary to bring the lift to the ground floor immediately, reversing its direction of travel. For this purpose, a switch, hereinafter called the fire switch, closes a circuit in parallel with the one which closes the emergency switch which only brings into series the pair of sensors corresponding to the ground or exit floor. This circuit passes through an electromagnet which reverses the commutators of the emergency motor and actuates a contactor which is normally open in parallel with said switch.

Finally, in parallel with this entire system there is optionally provided an emergency light which comes into operation at the beginning of the breakdown and lasts for a predetermined period with an electronic timer constituted by an integrated circuit such as, for example, the 555 type.

The characteristics of the present invention will be described with reference to the attached drawings which correspond merely to an embodiment given as an example with the indicated aim. Although the shape, dimensions and materials with which the various parts are produced will be the ones which are considered appropriate in each case for the relevant concrete application without such variations, the safety devices for the evacuation of lifts in emergency which are produced in accordance with the general idea described and any modifications thereof are only variations also covered and protected by the present invention.

BRIEF DESCRIPTION OF THE DRAWINGS

And finally.

DETAILED DESCRIPTION OF THE PREFERRED EMBODIMENT

With reference to the drawings and to the numerals thereon, which designate the parts and details of the device illustrated for the purposes of this specification, the description thereof is as follows.

Figure 2:
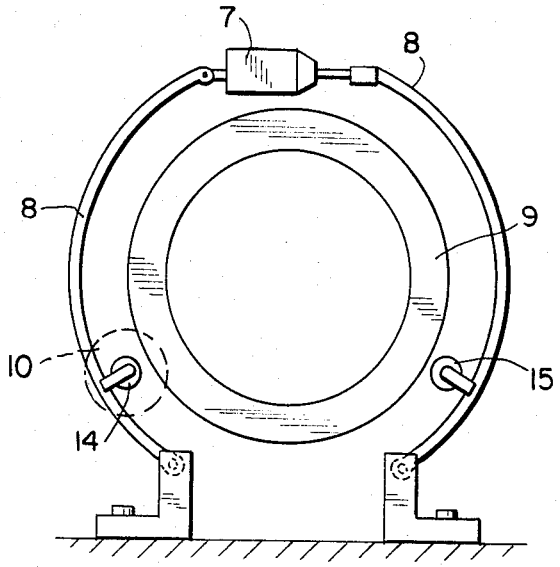
FIG. 2 shows a front detail of the inertia flywheel installation.
Figure 3:
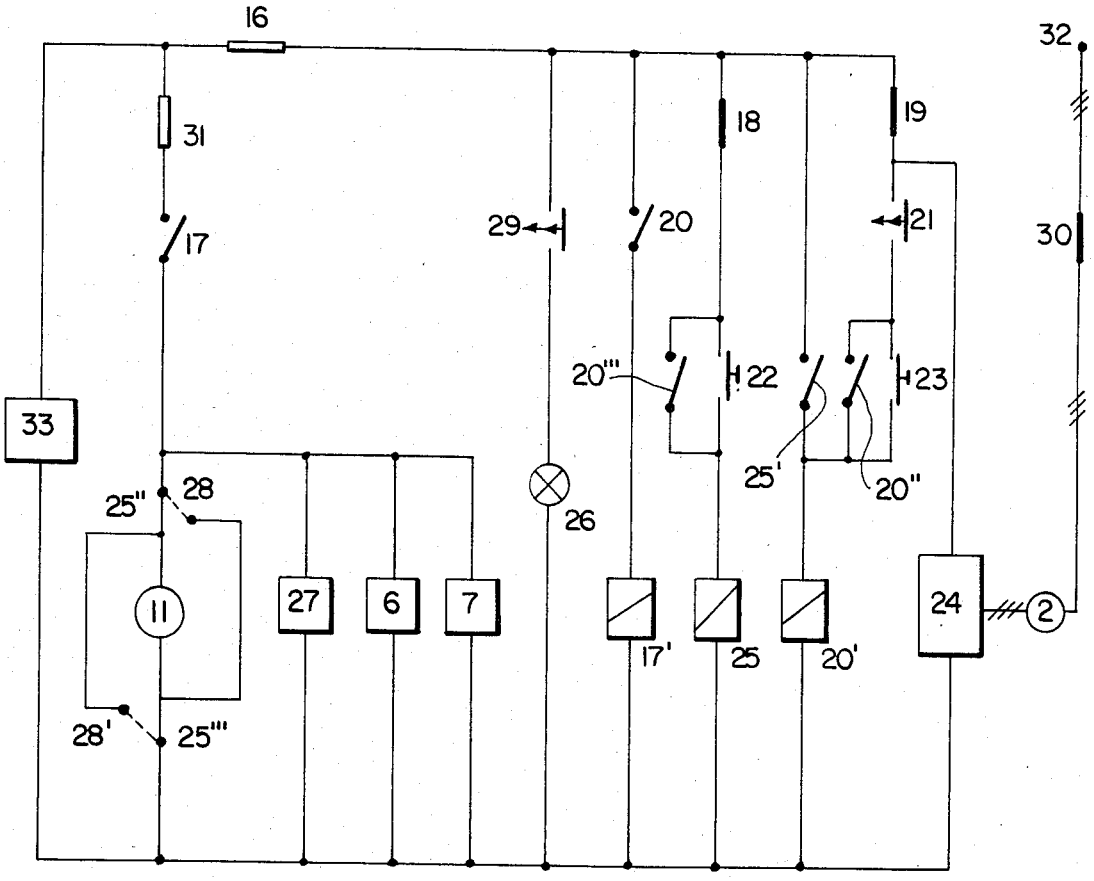
FIG. 3 shows the electric layout of all the components constituting the safety device.

The reduction motor 2 (FIG. 1) is supplied by the three phase current cables 1 whose connections reach the electronic safety device 24 as shown in FIG. 3. FIGS. 1A and 2 show how the inertia flywheel 9 is gripped by the frame 8 (FIGS. 1, 1A and 2) in which there run a wheel 14 (FIGS. 1A and 2) which is a driving wheel and a wheel 15 (FIG. 2) which is free. This frame 8 closes, pushing the wheels 14 and 15 against the inertia flywheel 9 when the electromagnet 7 is actuated (FIGS. 1, 1A and 2) on receiving the signal, as explained below.

Figure 1:
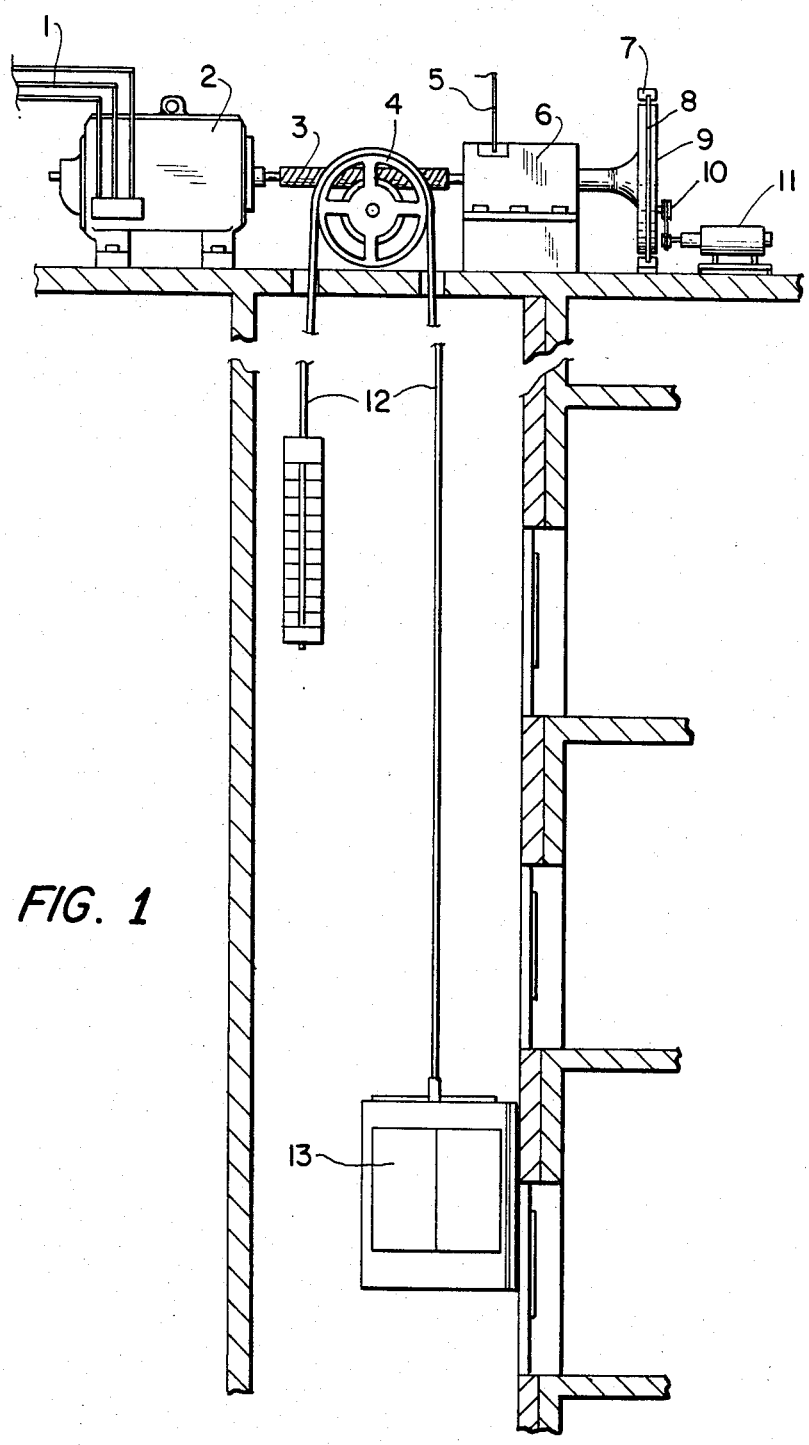
FIG. 1 shows the general assembly of mechanisms and a conventional lift shaft.
Figure 1A:
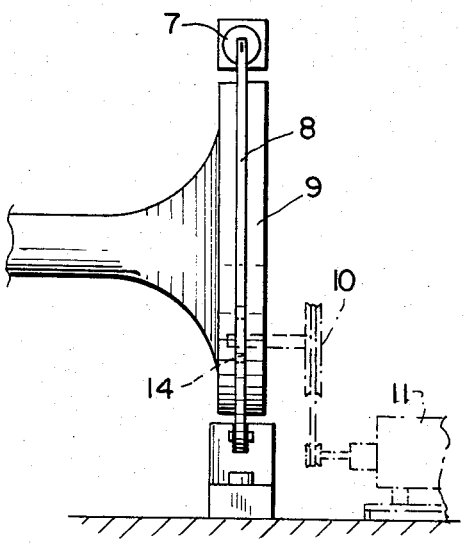
FIG. 1A shows a side detail of the inertia flywheel installation.

The driving wheel 14 is linked with a pulley 10 (FIGS. 1, 1A and 2) to the auxiliary motor 11 (FIGS. 1 and 1A). In an emergency, the cables 1 (FIGS. 1 and 3) of the main reduction motor 2 are disconnected from a network 32 and the main reduction motor 2 can come into operation, lifting the cabin 13 until it reaches the exit height of one of the floors, as shown in FIG. 1.

This FIG. 1 shows how the reduction motor 2 causes the spiral conveyor 3 to rotate and drag the pulley 4 of the cable 12 which lifts the cabin 13. The electric brake 6 is connected to the device by the cables 5. The electromagnet 7 is connected to the device as shown in FIG. 3, the connections not being shown in the other Figures.

The electronic device is shown in FIG. 3 and operates in the following manner. The circuit 24 is connected to the three phase reduction motor 2 which, in turn, is connected to the main network 32 via a commutator 30. This circuit 24 is designed in such a way that when, for any reason, it does not receive any signal corresponding to the supply phases of the motor 2, an output signal is produced and only then.

If this output signal is produced when the magnetic position finder 19 is not disconnected as the cabin 13 is not positioned in a precise location at the height of one of the floors, the contact 21 and the contact 29 close simultaneously. The contact 29 causes the light 26 to be illuminated for a predetermined period by an electronic timer. The contact 21 establishes the circuit for actuating the relay coil 20' in such a way that, as the emergency switch 23 is pushed, current passes through the relay coil 20' which closes the contact 20'', current passing through this circuit until the current is interrupted at contact 21 or at position finder 19. Once the relay coil 20' is actuated, the contact 20 closes as well as contact 20'' passing current through the relay coil 17' which closes the main contact or commutator 17. Once this contact 20 has been closed, it sets the converter into operation for supplying the electric brake 6 and the electromagnet 7 respectively as well as for supplying energy to the auxiliary motor 11 originating from the storage battery 33 for example.

The emergency circuit is protected by respective fuses 16 and 31.

When the lift reaches one of the stories, the magnetic position finder 19 opens, interrupting the supply of the circuit 24 and disconnecting from the battery the auxiliary motor 11, the electric brake 6 and the electromagnet 7 for pressing the jaws of the inertia flywheel 9.

The two most essential points of this invention are, in addition to the electronic safety circuit, the main coupling via the inertia flywheel 9 which consists of a jaw opening electromagnet, the electric brake converter for unblocking the main motor 2 and, in turn, enabling the emergency equipment to be moved. This converter for opening the brake 6 operates in parallel with a closing electromagnet 7 to which we have already referred and which is shown in FIGS. 1A and 2. The two arms are attached in the form of a hinge with two rollers made from wear-resistant material, one of the rollers serving to transmit sufficient power to cause the inertia flywheel 9 to rotate in the desired direction of rotation. In this way, the cabin 13 can rise or descend to the height of the next floor.

The two steel arms which grip the inertia flywheel 9 and in which the rollers to which we have referred are fixed do not affect the movement of the said flywheel 9 when they are not tightened.

The support for this assembly will be manufactured according to the type of installation required in each case.

Finally, the structure of the emergency fire circuit will be described next with reference to FIG. 3. The fire switch 22 actuates the relay coil 25 when the cabin 13 is not positioned perfectly on the ground or exit floor at which the magnetic position finder 18, which corresponds to this floor and is the only one inserted in the circuit, is closed. This coil 25 closes the contact 20''' with a function similar to contacts 20'' and 25', by means of which the coil 20' is actuated and the contact 20 is closed. It also acts on the contactors 25'' and 25''', bringing them to the positions 28 and 28' respectively so that the direction of rotation of the auxiliary motor 11 is reversed.

The present invention is encompassed by the following claims.

I claim:

1. A safety device for the emergency evacuation of a cabin at a safe floor in an elevator shaft, comprising:

a main motor having an electrical input and a mechanical output;

a three-phase current cable means, electrically connected to the main motor, for supplying electrical energy to the main motor;

a conveyor means, mechanically connected to the main motor, for lifting and lowering the cabin in the elevator shaft;

an electric brake having an electrical input side and a mechanical output end and being connected at the output end to the conveyor means;

an inertia flywheel being connected at the input side of the electric brake and having an outer periphery;

wheel means, positioned around the outer periphery of the inertia flywheel, for driving and stopping the inertia flywheel;

gripper frame means, positioned around the outer periphery of the inertia flywheel, for pushing the wheel means against the outer periphery of the inertia flywheel;

electromagnetic means, connected to the gripper frame means, for actuating the gripper frame means; and an auxiliary motor means, connected to the wheel means, for supplying mechanical energy to the wheel means;

whereby the inertia flywheel rotates when actuated in an emergency so that the conveyor means lifts/-lowers the cabin in the elevator shaft to the safe floor for evacuation.

2. The safety device, according to claim 1, further comprising:

an emergency light positioned in the cabin.

3. The safety device, according to claim 1, further comprising:

an emergency switch means, positioned in the cabin, for actuating the auxiliary motor means.

4. The safety device, according to claim 3, further comprising:

an electrical coil means, actuated by the emergency switch means, for repositioning the cabin to the safe floor for evacuation.

5. The safety device, according to claim 4, further comprising:

at least one magnetic means, electrically connected with the emergency switch means, for finding the position of the safe floor in the elevator shaft.

* * * * *